United States Patent [19]

Ashok et al.

[11] Patent Number: 5,074,933

[45] Date of Patent: Dec. 24, 1991

[54] COPPER-NICKEL-TIN-SILICON ALLOYS HAVING IMPROVED PROCESSABILITY

[75] Inventors: Sankaranarayanan Ashok, Bethany; John F. Breedis, Trumbull, both of Conn.

[73] Assignee: Olin Corporation, New Haven, Conn.

[21] Appl. No.: 384,363

[22] Filed: Jul. 25, 1989

[51] Int. Cl.[5] ..... C22C 1/02; C22C 9/01; B05D 1/08

[52] U.S. Cl. ..... 148/315; 148/435; 420/473; 420/486; 420/487

[58] Field of Search ..... 420/473, 486, 487; 148/435, 315

[56] References Cited

U.S. PATENT DOCUMENTS

| | | | |
|---|---|---|---|
| Re. 31,767 | 12/1984 | Brooks | 29/527.2 |
| 3,923,555 | 12/1975 | Shapiro et al. | 148/11.5 A |
| 4,012,240 | 3/1977 | Hinrichsen et al. | 148/11.5 C |
| 4,076,560 | 2/1978 | Hoyt, Jr. et al. | 148/11.5 C |
| 4,196,237 | 4/1980 | Patel et al. | 420/486 |
| 4,378,332 | 3/1983 | Chang et al. | 420/473 |
| 4,415,374 | 11/1983 | Young et al. | 148/2 |
| 4,540,546 | 9/1985 | Giessen | 148/435 |
| 4,594,117 | 6/1986 | Pryor et al. | 420/486 |
| 4,661,178 | 4/1987 | Ashok et al. | 420/496 |
| 4,711,611 | 12/1987 | Kemp, Jr. et al. | 75/252 |
| 4,732,625 | 3/1988 | Livak | 148/433 |
| 4,804,034 | 2/1989 | Leatham | 164/46 |
| 4,808,218 | 2/1989 | Wagner et al. | 264/13 |
| 4,822,693 | 4/1989 | Ashok et al. | 420/487 |
| 4,927,467 | 5/1990 | Kusakawa et al. | 148/3 |
| 4,961,457 | 10/1990 | Watson et al. | 164/46 |
| 4,971,113 | 11/1990 | Ashok et al. | 164/46 |

FOREIGN PATENT DOCUMENTS

| | | | |
|---|---|---|---|
| 0122840 | 9/1980 | Japan | 420/473 |
| 55-148739 | 11/1980 | Japan . | |
| 56-000265 | 2/1981 | Japan . | |
| 56-005942 | 2/1981 | Japan . | |
| 2172900 | 10/1986 | United Kingdom . | |

OTHER PUBLICATIONS

International Copper Research Association, Inc. "Incra Series on the Metallurgy of Copper", published Feb. 15, 1979 at pp. 426–429 468–477 601 and 608.

Osprey Metals, Ltd. "The Osprey Preform Process" undated, included in a reprint from Modern Developments in Powder Metallurgy, 1985.

Singh et al., "Evolution of Microstructure in Spray CastCu-Zr".

Yefimov et al., Journal of Less Common Metals, vol. 97 at pp. 271–275 (1984).

*Primary Examiner*—Upendra Roy

*Attorney, Agent, or Firm*—Gregory S. Rosenblatt; Paul Weinstein

[57] ABSTRACT

The invention provides a process for the manufacture of copper alloys having improved processability. The alloys are melted and atomized into droplets which are spray cast into a coherent deposit. The spray cast alloys are characterized by a finer dispersion of intermetallic than is possible by conventional casting. The alloys are capable of being cold rolled to a reduction of up to 70%. The spray cast alloys exhibit good electrical conductivity and a high yield strength. They are particularly suited for electrical spring contacts.

9 Claims, 3 Drawing Sheets

COPPER-NICKEL-TIN-SILICON ALLOYS HAVING IMPROVED PROCESSABILITY

BACKGROUND OF THE INVENTION

1. Field of the Invention

The present invention relates to copper alloys having improved processability. More particularly, the ductility of the alloys is increased by spray casting permitting greater cold rolling reductions.

2. Description of the Background

Alloying elements are typically added to copper to increase the yield strength, improve corrosion resistance, increase the resistance to thermally induced softening or to impart the metal with other desirable properties. The alloying is usually accomplished by dissolving the desired concentration of alloying elements within molten copper. When the mixture cools, an alloy having the desired concentration of elements is formed. For many combinations of elements, a non-uniform distribution of alloying elements occurs during cooling. The localized concentration of additives is known as microsegregation. This phenomenum is undesirable. The segregated regions reduce the processability and the electrical conductivity of the bulk alloy.

One alloy system which is prone to microsegregation is a copper base alloy containing nickel, tin and silicon. The alloy has high strength and excellent mechanical properties. The electrical conductivity is about 5% to about 10% that of pure copper. While low compared to copper, the conductivity is comparable to other alloys having similar mechanical properties. These alloys typically find use as spring type connectors. The spring temper of the connector must be retained following numerous insertion and removal cycles.

To date, copper-nickel-tin-silicon alloys have met with limited commercial acceptance due to limited processability. The alloy is subject to severe microsegregation. A brittle nickel-tin intermetallic phase segregates from the alloy matrix during cooling severely reducing the ductility of the bulk alloy.

The usual method of minimizing microsegregation is to solutionize the alloy. The alloy is heated to a temperature sufficient to dissolve the intermetallic phase into the alloy. The solutionized alloy is then rapidly solidified by quenching to minimize the growth of the intermetallic phase. Rapid solidification is intended to freeze in the solutionized microstructure. It is inadequate for copper base alloys prone to microsegregation. The intermetallic phase forms so quickly that even when solutionization is followed by quenching, the alloy exhibits edge cracking during cold rolling. The alloy also has limited hot rolling processability.

SUMMARY OF THE INVENTION

In accordance with the invention, the inventors have developed a process to manufacture the copper alloys by spray casting. The spray cast alloys are capable of cold roll reductions of about 30% without edge cracking. If the spray cast alloy is subsequently solution annealed and water quenched, cold rolling reductions of up to about 70% are obtainable. It is an advantage of the invention that microsegregation is inhibited. It is a feature of the invention that a coherent cast article is formed from a plurality of very small droplets which are rapidly solidified and the formation of a coarse intermetallic is reduced. It is another advantage of the invention that the spray cast alloys may be readily fabricated into commercially desirable products. Spring contacts manufactured from spray cast copper-nickel-tin-silicon alloys exhibit superior mechanical properties.

Accordingly, there is provided a method for the manufacture of copper base alloys which form a brittle intermetallic phase by spray casting. The spray cast alloys exhibit improved cold rolling processability. The intermetallic which does develop has a fine grain size and a reduced volume compared to conventionally cast alloys of the same composition. The alloys of the invention are formed by (1) atomizing a molten stream of the desired copper alloy; (2) rapidly cooling the atomized particles so that the particles are at or near the solidification temperature; and (3) depositing the particles on a moving collector such that the particles solidify at a rate sufficiently high to effectively inhibit the growth of a coarse intermetallic phase and to generate a coherent alloy preform having a desired shape.

The above stated objects, features and advantages as well as others will become apparent to those skilled in the art from the specification and accompanying figures which follow.

DESCRIPTION OF THE PREFERRED EMBODIMENT

Figure 1:
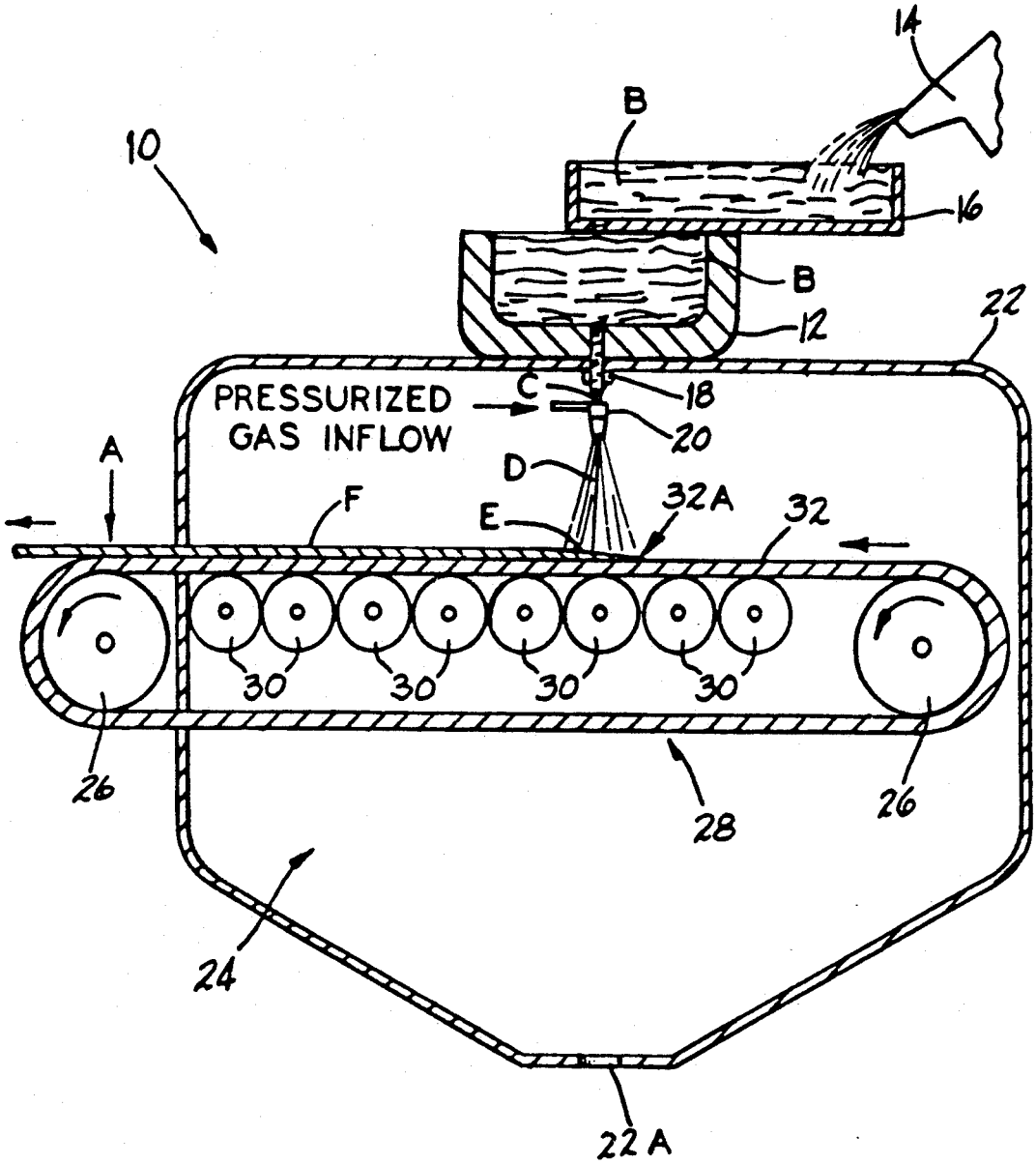
FIG. 1 illustrates a spray deposition apparatus for use in accordance with the process of the invention.

FIG. 1 illustrates a spray deposition apparatus 10 of the type disclosed in U.S. Pat. Nos., RE 31,767 and 4,804,034 as well as United Kingdom Patent No. 2,172,900 A all assigned to Osprey Metals Limited of Neath, Wales. The system as illustrated produces a continuous strip of product A. The manufacture of discrete articles is also possible by adapting the shape of the collecting surface.

The spray deposition apparatus 10 employs a tundish 12 in which a metal alloy having a desired composition B is held in molten form. The tundish 12 receives the molten alloy B from a tiltable melt furnace 14, via a transfer lauder 16. The tundish 12 further has a bottom nozzle 18 through which the molten alloy B issues in a continuous stream C. A gas atomizer 20 is positioned below the tundish bottom nozzle 18 within a spray chamber 22 of the apparatus 10.

The atomizer 20 is supplied with a gas under pressure from any suitable source. The gas atomizes the molten metal and provides a protective atmosphere to prevent oxidation of the atomized droplets. The composition of the gas is preferably selected so as not to react with the molten droplets. For a copper based alloy system, preferred atomizing gases include nitrogen, argon and forming gas (96% by volume nitrogen, 4% by volume hydrogen), although any suitable gas may be employed.

The oxygen concentration of the gas should be minimal, below 100 ppm and preferably below 10 ppm.

The gas is impinged against the molten alloy stream producing droplets. The mean particle size of the droplets is related to the ratio of gas volume to metal. While the gas pressure (from about 30 psi to about 150 psi) will vary depending on the diameter of molten alloy stream and the diameter of the atomizer orifices, a gas volume to metal ratio of about 0.24 $m^3/kg$ to about 1.0 $m^3/kg$ produces droplets having a mean particle size in the range of from about 50 microns to about 500 microns.

The atomizer 20 surrounds the molten metal stream C and impinges the gas on the stream C so as to convert the stream C into a spray D. The spray D comprises a plurality of atomized droplets which are broadcast downward from the atomizer 20 in a divergent conical pattern. If desired, more than one atomizer may be used. The atomizer(s) 20 may be moved in a desired pattern for more uniform distribution of the molten metal particles.

The droplets are collected on a continuous substrate system 24. The substrate system 24 extends into the spray chamber 22 in generally horizontal fashion and in spaced relationship to the gas atomizer 20. The substrate system 24 includes a drive means comprising a pair of spaced rolls 26, an endless belt substrate 28 and a series of rollers 30. An area 32A of the substrate upper run 32 directly underlies the divergent pattern of spray D. The area 32A receives a deposit E of the atomized metal particles to form the metal strip product A.

The atomizing gas flowing from the atomizer 20 is much cooler than the molten metal B in the stream C. The impingement of atomizing gas on the particles during atomization and in flight as well as the subsequent deposition of the droplets on the substrate 28 extract heat from the particles. The metal deposit E is cooled to below the solidus temperature of the alloy B forming a solid strip F. The strip F is carried from the spray chamber 22 by the substrate 28.

The droplets striking the collecting surface 28 are preferably partially solidified or supercooled so that solidification occurs rapidly upon impact. By controlling the spacing between the atomizer and the collector as well as the droplet temperature, the solidification rate may be controlled. When the solidification rate is rapid enough, segregation is effectively inhibited within the individual droplets as well as within the bulk alloy.

The strip F is a coherent mass of individual droplets. The droplets have a mean particle diameter of from about 75 microns to about 250 microns. Each droplet contains a fine segregated intermetallic phase. The droplets solidify upon impact with the collector surface. If the solidification rate is sufficiently rapid, the fine microstructure is frozen into the bulk alloy. The coarse second phase which develops during conventional casting is inhibited from forming when spray casting is employed in accordance with the invention.

The droplets are cooled at a rate of at least about 1° C. per second and preferably from about 10° C. per second to about 100° C. per second. The temperature of the molten alloy, the gas volume to metal ratio, the gas flow rate, the temperature of the gas, the collector surface temperature and the distance between the atomizer and the collector surface all influence the cooling rate. Some experimentation may be required to optimize parameters to minimize microsegregation.

For most copper base alloys, the following values are exemplary:

a. Melt temperature = 1200°.
b. Gas volume to metal ratio = 45 psi.
c. Collector surface = copper foil over a glass ceramic such as PYREX, the collector surface is initially at room temperature.
d. Distance between atomizer and and collector = 200 mm.

The benefits which result from the invention will become more clear from the following examples which are intended to be exemplary and not intended to limit the composition of the claimed alloys.

EXAMPLE 1

An alloy containing 15% by weight nickel, 7% by weight tin, 1% by weight silicon and the balance copper was cast by a conventional process, Durville casting. Durville casting comprises attaching an inverted mold to the top of a crucible; melting an alloy in the bottom of the crucible; and decanting the molten alloy into the mold by inverting the entire apparatus.

The Durville cast alloy was extremely brittle. Severe cracking occurred when cold rolling thickness reductions as small as 1% were taken. To improve processability, the alloy was solutionized by heating to 900° C. and held at temperature for 8 hours. The alloy was then water quenched in an attempt to freeze in the solutionized microstructure. The alloy was brittle and cold rolling reductions in excess of about 1% were not possible.

Figure 2:
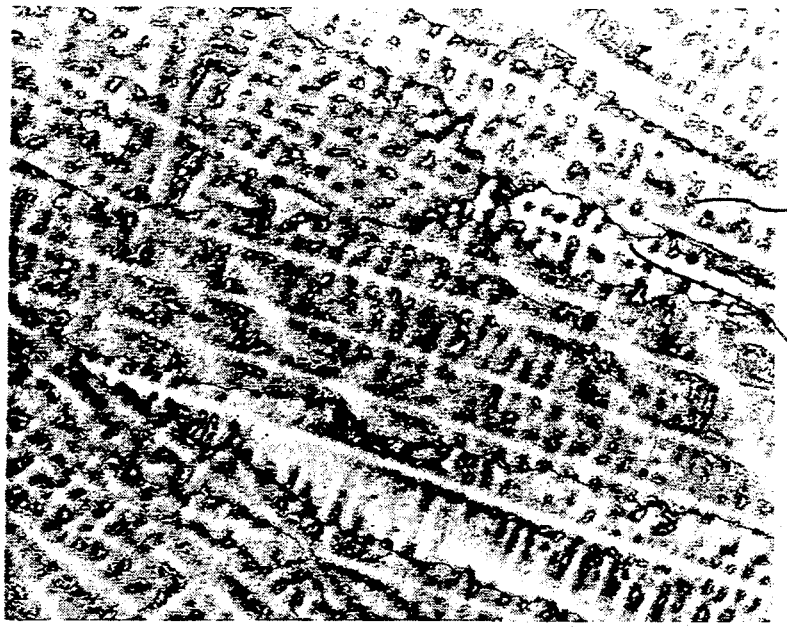
FIG. 2 is a micrograph, magnified 100 times, illustrating the coarse intermetallic phase which develops when a copper-nickel-tin-silicon alloy is cast by prior art techniques.

The conventionally cast copper - 15% nickel - 7% tin - 1% silicon was brittle and not suitable for cold rolling. FIG. 2 shows in cross section the Durville cast alloy magnified 100 times. The cross section was prepared by polishing a transverse sample of the cast alloy with progressively finer grit medium down to a 6 micron colloidal silicate. The polished sample was etched with ASM #4 diluted 1:4 with water to enhance the contrast. ASM #4 is a standard etch containing 40 $CrO_3$; 7.5 gm $NH_4Cl$; 50 ml $HNO_3$; 50 ml $H_2SO_4$; and 850 ml $H_2O$.

As shown in FIG. 2, the conventionally cast alloy comprises a matrix 10 of the copper base alloy having approximately the same composition as the molten melt. An intermetallic phase 12 consisting of a nickel-tin alloy is present throughout the matrix. The intermetallic phase 12 is coarse and occupies a significant volume of the alloy. The intermetallic is brittle and the lack of ductility is imposed on the bulk alloy. The conventionally cast alloy is extremely brittle.

The intermetallic forms readily and grows quickly. Even after solutionization, the cooling rate during quenching is inadequate to inhibit the formation and coarsening of the intermetallic.

Figure 3:
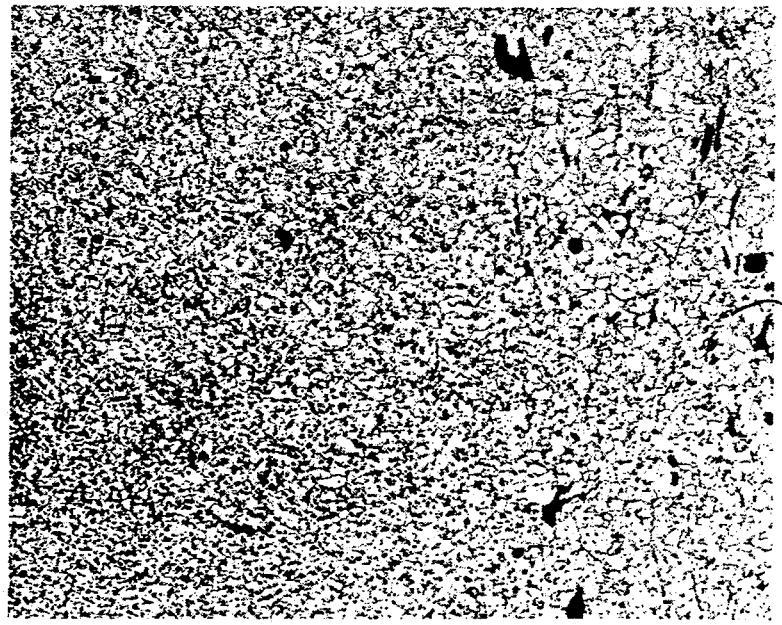
FIG. 3 is a micrograph magnified 100 times, illustrating the reduced volume and finer structure of the intermetallic phase of a spray cast copper-nickel-tin-silicon alloy in accordance with the invention.

The same alloy composition was also cast by spray casting according to the process of the invention. As shown in FIG. 3, the intermetallic phase is dispersed so that rather than a coarse dominant intermetallic phase, an evenly dispersed fine intermetallic phase 14 is present. FIG. 3 is a cross section of the spray cast copper-nickel-tin-silicon alloy. The cross section was prepared and etched by the same process used for the Durville cast alloy illustrated in FIG. 2.

The intermetallic 14 is finer and more uniformly dispersed throughout the matrix 16. The intermetallic does not affect the properties of the bulk alloy to same extent as the more coarse intermetallic of the conventionally cast alloy.

The spray cast alloy illustrated by the micrograph of FIG. 3 was capable of cold rolling reductions of in excess of about 30%. When the spray cast alloy was solutionized by heating to 900° C. for 1 hour followed by water quenching, cold rolling reductions in excess of about 70% were achieved without edge cracking.

EXAMPLE 2

An alloy consisting of 9% by weight nickel, 6% by weight tin, 1% by weight silicon and the balance copper was cast by conventional Durville casting and by spray casting in accordance with the invention. The Durville cast alloy exhibited edge cracking during a cold rolling reduction of less than about 1%. The spray cast alloy was capable of cold rolling to a reduction of about 60% before cracking.

Spray casting will improve the processability of copper-nickel-tin-silicon alloys within a range of compositions. Preferably, the alloys have a composition within he following ranges:

from about 4% to about 20% nickel. If the nickel concentration is below about 4%, the alloy strength is insufficient for a spring type connector to withstand repeated insertions. If the nickel concentration exceeds about 20%, multiple alloy phases develop reducing the electrical conductivity of the bulk alloy.

from about 4% to about 10% by weight tin. Below about 4% tin, the strength of the alloy is insufficient, while above about 10% tin the alloy cracks during cold rolling.

an effective amount of silicon up to about 3%. Silicon adds strength to the alloy, so that an effective amount is that which will increase the yield strength of the copper-nickel-tin-silicon alloy. However, the ability to cold work the alloy is limited by the presence of silicon. Above about 3% by weight silicon, the spray cast alloy exhibits edge cracking during cold rolling.

The balance of the alloy is copper along with whatever trace impurities are typically included with commercial copper alloys.

More preferably for both electrical and mechanical properties, the alloy has the composition:

from about 8% to about 16% nickel.

from about 7% to about 8% tin from about 0.5% to about 1.5% silicon and the balance copper along with trace commercial impurities.

Figure 4:
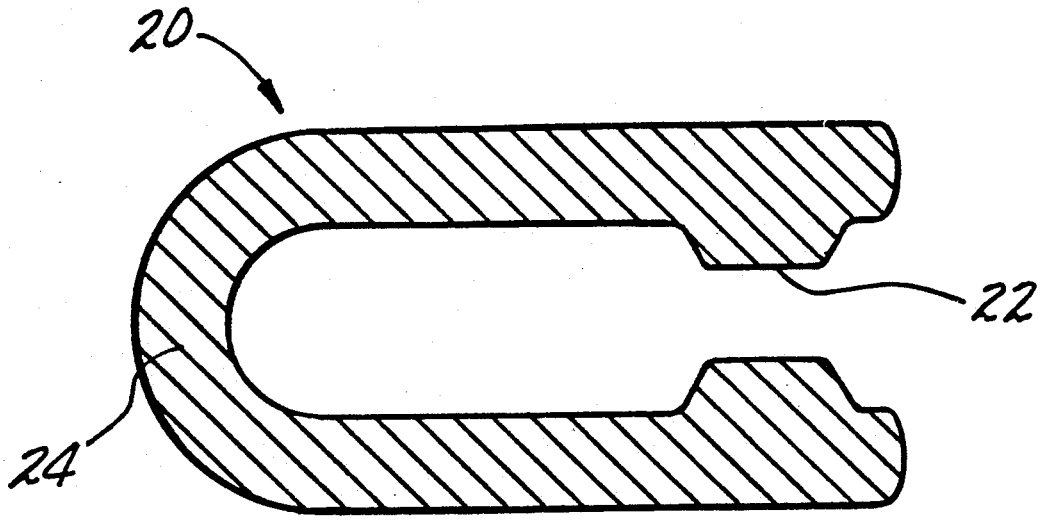
FIG. 4 illustrates in cross-sectional representation, a spring electrical contact manufactured from the spray cast alloy of the invention.

The copper-nickel-tin-silicon alloys of the invention have particular utility as spring type electrical connectors due to good electrical conductivity and high mechanical strength. FIG. 4 illustrates in cross-sectional representation a spring type connector 20. The connector 20 is a socket comprising a contact area 22 designed to make electrical contact with a jack or a plug. A radius 24 applies a stress to the ends of the socket so that the contact area 22 is firmly pressed against the jack. Due to the superior yield strength of the copper alloys of the invention, the jack may be inserted and removed from the socket 20 more often than from sockets produced from conventionally cast copper alloys before the radius 24 yields and the positive pressure applied by the contact areas 22 is reduced.

The socket may be manufactured by any conventional process to form sockets from strip. For example, the cast strip may be cold rolled to a reduction of from about 30% to about 70% to obtain a desired thickness and to increase the temper of the spring. A blank is then stamped from the strip an the blank formed into a socket.

While the invention has been described in terms of a copper-nickel-tin-silicon alloy system, the processability of other copper base alloys which segregate and form a coarse brittle intermetallic may be improved by the process of the invention. For example, the following alloy systems are believed to have improved processability if cast by spray coating.

Copper-Nickel-Iron and Copper-Nickel-Cobalt, each containing at least about 15% by weight nickel and at least about 15% by weight iron or cobalt. These alloys, better known as CUNIFE and CUNICO, respectively, are used as permanent magnets. The alloys are difficult to roll and the process of the invention will improve the cold rollability of the alloys. The more preferred alloy composition is from about 20.5% to about 21.5% by weight Ni, 28.5% to about 29.5% by weight cobalt and the balance copper for CUNICO. For CUNIFE, from about 19.5% to about 20.5% by weight Ni, from about 19.5% to about 20.5% by weight iron and the balance copper.

Other allow systems which will be improved by the added ductility achieved by spray casting include copper-nickel-aluminum (containing at least about 15% by weight Ni, at least about 5% by weight Al and the balance copper; Copper-Chromium-Manganese; and Copper-Magnesium Alloys.

The patents set forth in the application are intended to be incorporated by reference.

It is apparent that there has been provided in accordance with this invention a method to produce copper base alloys wherein the intermetallic phase has a reduced effect on the properties of the bulk alloy which fully satisfies the objects, means, and advantages set forth hereinbefore. While the invention has been described in combination with specific embodiments and examples thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A spray cast alloy formed from a coherent mass of droplets, said alloy having improved cold rolling process ability in the as cast condition and being comprised of:

a copper based alloy matrix; and a uniformly dispersed brittle intermetallic phase having a size limited by said droplets which exhibits reduced microsegregation as compared to a conventionally cast copper alloy of the same composition.

2. The spray cast alloy of claim 1 wherein said alloy consists essentially of from about 4% to about 20% by weight nickel, from about 4% to about 10% by weight tin, an effective amount of about 3% by weight silicon and the balance copper.

3. The spray cast alloy of claim 1 wherein said alloy consists essentially of from about 4% to about 20% by weight nickel, from about 4% to about 10% by weight tin, from about 1% to about 3% by weight silicon and the balance copper.

4. The spray cast alloy of claim 1 wherein said alloy consists essentially of at least about 15% by weight nickel, at least about 5% by weight aluminum and the balance copper.

5. The spray cast alloy of claim 2 wherein said alloy consists essentially of from about 8% to about 16% by weight nickel, from about 7% to about 8% by weight tin, from about 0.5% to about 1.5% by weight silicon and the balance copper.

6. The spray cast alloy of claim 3 wherein said alloy consists essentially of from about 8% to about 16% by weight nickel, from about 7% to about 8% by weight tin, from about 1.0% to about 1.5% by weight silicon and the balance copper.

7. A spray cast alloy formed from a coherent mass of droplets, said alloy having improved cold rolling processability in the as cast condition and consisting essentially of:

at least about 15% by weight nickel; at least about 15% by weight of an element selected from the group consisting of cobalt and iron; and the balance copper wherein said spray cast alloy has:

a copper based alloy matrix; and a uniformly dispersed discrete second phase having a size limited by said droplets which exhibits reduced microsegregation as compared to a conventionally cast copper alloy of the same composition.

8. The spray cast alloy of claim 7 wherein said alloy consists essentially of from about 20.5% to about 21.5% by weight Ni, from about 28.5% to about 29.5% by weight Co and the balance copper.

9. The spray cast alloy of claim 7 wherein said alloy consists essentially of from about 19.5% to about 20.5% by weight Ni, from about 19.5% to about 20.5% by weight Fe and the balance copper.

* * * * *